US007462771B1

(12) United States Patent
McCraw

(10) Patent No.: US 7,462,771 B1
(45) Date of Patent: Dec. 9, 2008

(54) NO DRILL SNARE DRUM STRAINER ADAPTER

(75) Inventor: Michael Thomas McCraw, Oklahoma City, OK (US)

(73) Assignee: Michael T. McCraw, Oklahoma City, OK (US)

( * ) Notice: Subject to any disclaimer, the term of this patent is extended or adjusted under 35 U.S.C. 154(b) by 0 days.

(21) Appl. No.: 11/415,641

(22) Filed: May 2, 2006

Related U.S. Application Data

(60) Provisional application No. 60/681,057, filed on May 16, 2005.

(51) Int. Cl.
*G10D 13/02* (2006.01)

(52) U.S. Cl. ..... 84/415

(58) Field of Classification Search ..... 84/411 R, 84/421, 415, 416, 417
See application file for complete search history.

(56) References Cited

U.S. PATENT DOCUMENTS

| | | | | |
|---|---|---|---|---|
| 4,339,982 | A | 7/1982 | Hoshino | |
| 5,557,053 | A * | 9/1996 | Nickel | 84/415 |
| 5,616,875 | A | 4/1997 | Lombardi | |
| 5,627,336 | A * | 5/1997 | Stevens | 84/746 |
| 6,020,547 | A | 2/2000 | Chen | |
| 6,093,877 | A | 7/2000 | Nickel | |
| 6,573,442 | B1 | 6/2003 | Lombardi | |
| 6,846,978 | B2 | 1/2005 | Dorfman | |
| 6,891,098 | B1 | 5/2005 | Lombardi | |

* cited by examiner

*Primary Examiner*—Kimberly R Lockett

(57) ABSTRACT

A method and device for mounting a Snare drum strainer on a snare drum in place of an Anti-Friction Drum Strand Tensioner or Drum Strand Tensioner. The device consists of a small plate with one or more strategically placed holes to mount the snare drum strainer vertically. The plate is then attached vertically to the snare drum via the strategically placed holes. Attachment is temporary and secure and universal.

4 Claims, 2 Drawing Sheets

NO DRILL SNARE DRUM STRAINER ADAPTER

CROSS REFERENCE TO RELATED APPLICATIONS

This application claims the benefits of PPA Ser. No. 60/681,057 filed 2005, May, 16 by the present inventor.

FEDERALLY SPONSORED RESEARCH

Not Applicable.

SEQUENCE LISTING OR PROGRAM

None.

BACKGROUND OF THE INVENTION

1. Field of Invention

This invention relates to a snare drum strainer. More specifically, the invention allows a person to mount one brand of snare drum strainer on another brand of snare drum in place of an antifriction drum strand tensioner or a drum strand tensioner.

2. Background of the Invention

This invention relates generally to a snare drum strainer for use during the playing of a snare drum. More particularly, this invention relates to attaching or fastening one brand of snare drum strainer to a different brand of snare drum without modifying the different brand of snare drum's shell or the snare drum strainer.

The operation of a snare drum can be a frustrating experience, especially when the Anti-Friction Drum Strand Tensioner Snare tension adjustment mechanism doesn't have the capability to adjust the tension to the desired sensitivity. Complicating this frustration is the design of aftermarket snare drum strainers that utilize different spacing for the fasteners to secure them to the drum. Furthermore, the weight of such a device is of importance to both the sound of the drum and its sensitivity, and the weight of the drum itself due to portability concerns.

One such device is U.S. Pat. No. 6,891,098 to Lombardi. Those familiar with the art will realize that this device will choke the sound of the drum due to its inherent design characteristics. Furthermore, the bulky design increases the weight of the drum.

Other proposed devices, such as U.S. Pat. No. 6,573,442 to Lombardi also choke the sound of the drum. Also, due to the intricate nature of this device, weight becomes an issue as well as the bulk of the device.

Other proposed devices, such as U.S. Pat. No. 5,616,875 to Lombardi also choke the sound of the drum. Also, due to the intricate nature of this device, weight becomes an issue as well as the bulk of the device. Furthermore, the intricacies of this design are prone to breakage, thus causing the device to fail all together.

Other devices, such as U.S. Pat. No. 4,339,982 to Hoshino are of a design that is bulky and prone to breakage due to design flaws. Furthermore this design will choke the sound of the drum.

Other devices, such as U.S. Pat. No. 5,557,053 to Nickel are of an acceptable design but offer no convenient method to attach to the drum. Glue and/or adhesives would offer no secure attachment to the drum. Velcro would not offer secure attachment to the drum.

Other devices, such as U.S. Pat. No. 6,093,877 to Nickel are of an acceptable design but offer no convenient method to attach to the drum. Glue and/or adhesives would offer no secure attachment to the drum. Velcro would not offer secure attachment to the drum.

Other devices, such as U.S. Pat. No. 6,846,978 to Dorfman are of an acceptable design but offer no convenient method to attach to the drum. Glue and/or adhesives would offer no secure attachment to the drum. Velcro would not offer secure attachment to the drum.

Some proposed devices, such as U.S. Pat. No. 6,020,547 to Chen, use a slot to fasten the device to the drum which will eventually allow slipping of the device and will require constant re-adjustment of the entire device, creating even more frustration. Furthermore, this design will cause the sound of the drum to be choked.

Other proposed devices allow for constant slipping of the tension adjustment.

OBJECTS AND ADVANTAGES

The proposed device provides advantages and improvements over previous inventions as follows:

(a) To provide a uniform and secure and temporary mounting surface to which a Snare drum Strainer aftermarket device can be mounted.

(b) To provide for the use of the existing attachment access holes on the shell of the drum to secure the device to the drum.

(c) To provide a surface which fits securely and neatly to the arc of the drum.

(d) To provide a easy and convenient method of attaching the Snare Drum Strainer to a Snare drum.

(e) To be completely and easily reversible in nature.

SUMMARY

An object of the invention is to provide a method and device for a person to easily, accurately and securely fasten an aftermarket snare drum strainer using an easily attachable device without damage to either snare drum or snare drum strainer.

DETAILED DESCRIPTION

FIG. 1—Preferred Embodiment

A preferred embodiment of the device is illustrated in FIG. 1.

DETAILED DESCRIPTION OF THE INVENTION

Figure 1:
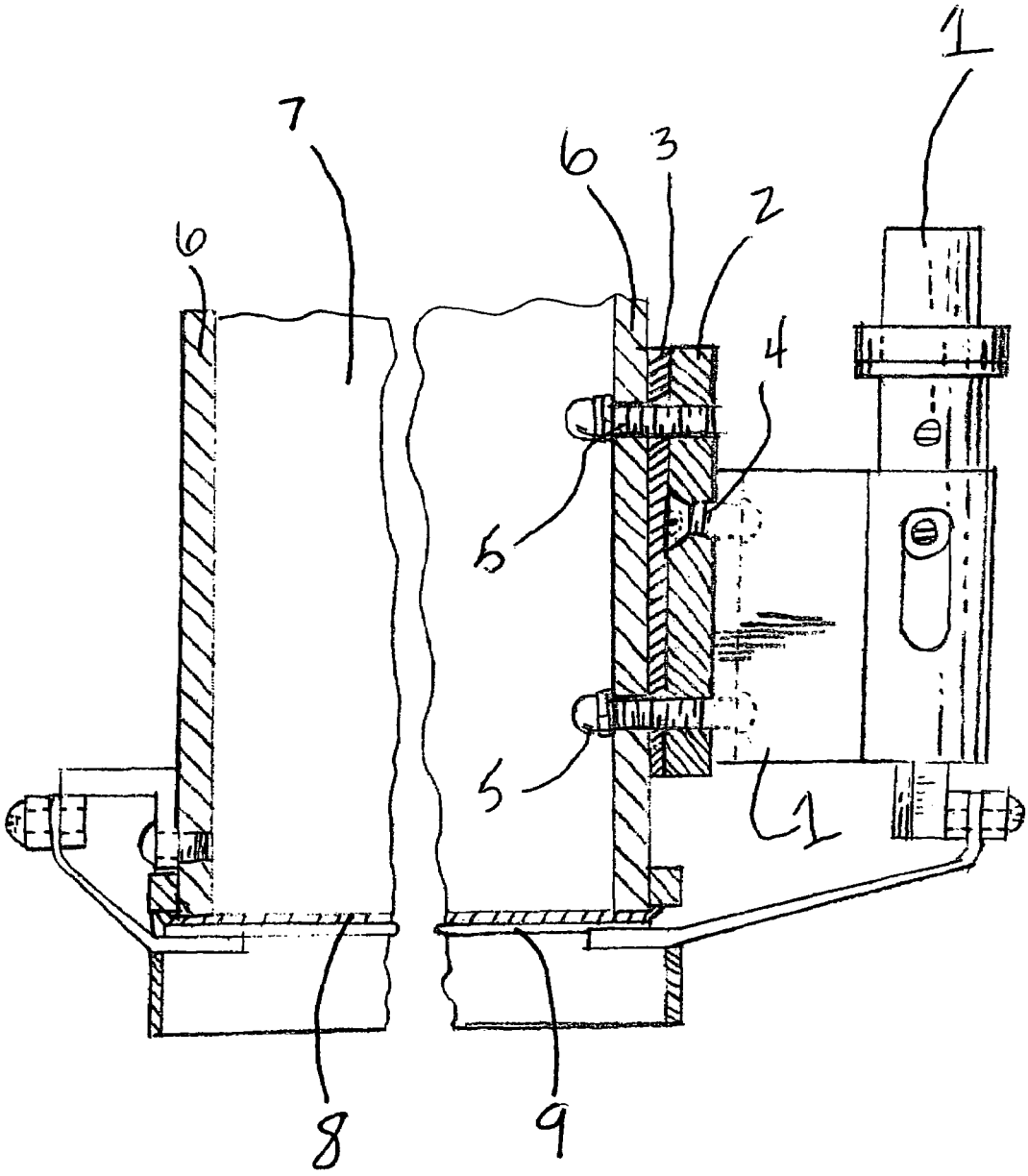
FIG. 1 is a cross-sectional view of a snare drum, the Snare Drum strainer and the No Drill Snare Drum Strainer Adapter.

An adapter 2 for use in conjunction with a strainer 1, sometimes called a throw-off mechanism, for use on a snare drum 7. Snare drum 7 includes a shell 6, at least one drum head 8, and a plurality of snare strands 9 mounted to snare drum 7 in parallel to the drum head 8.

The novel adapter 2 utilizes a plurality of holes to be used in conjunction with a plurality of fasteners 4 5. At least one of the holes of the novel adapter 2 is countersunk in order to avoid interference with snare drum shell 6 but secure the adapter 2 to the snare drum strainer 1 with fastener(s) 4. At least one hole is utilized in order to secure the adapter 2 to the snare drum shell 6 with fastener(s) 5. A neoprene rubber isolation pad 3 is utilized in order to minimize any shell surface marring.

Figure 2:
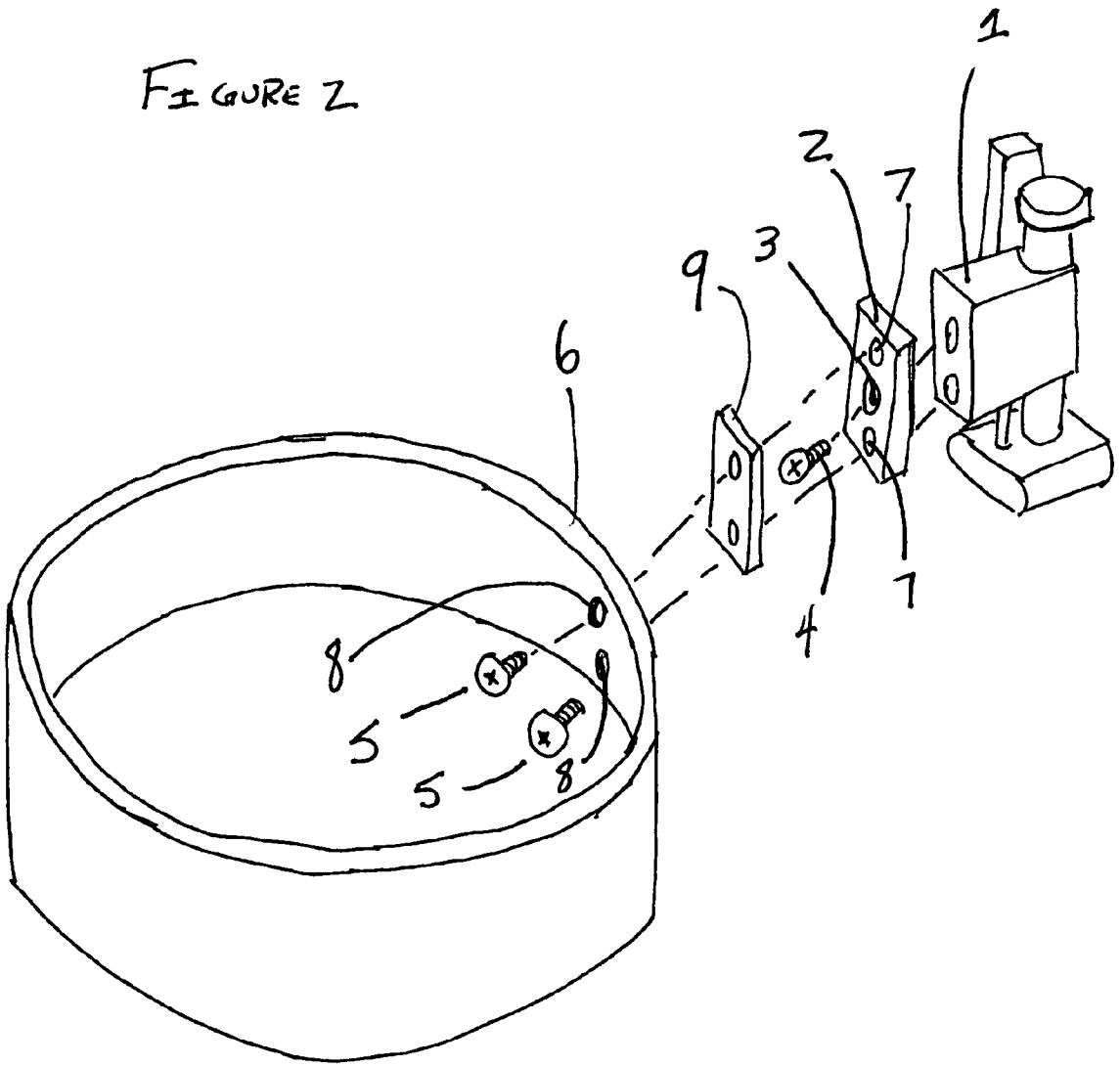
FIG. 2 is a perspective view of a snare drum, the snare drum strainer and the No Drill Snare Drum Strainer Adapter.

Turning to FIG. 2, the novel adapter 2 is again secured to the Snare Drum Strainer 1, sometimes referred to as a throw-off mechanism, by the use of a plurality of one or more holes 3 strategically placed and countersunk in order to avoid interference by the fastener(s) 4 with the snare drum shell 6. At least one hole 7 is utilized in order to secure the adapter 2 to the snare drum shell by fasteners 5 while utilizing the original holes 8 in the snare drum shell 6. A neoprene rubber isolation pad 9 is utilized in order to minimize any marring of the shell surface of the snare drum.

I claim:

1. An adapter for mounting an aftermarket snare drum strainer and to the shell of a snare drum, said snare drum having a plurality of original drum strainer mounting holes formed in said shell according to a first spacing, said aftermarket snare drum strainer having a plurality of mounting holes according to a second spacing, where holes in said first spacing holes in said second spacing do not mechanically align, said adapter comprising:

an adapter plate having:

at least one common hole formed in said adapter plate in alignment with both said first spacing and said second spacing;

one or more strainer-to-adapter mounting holes formed in said adapter plate in alignment with said aftermarket snare drum strainer according to said second spacing, at least one of said strainer mounting holes being countersunk to allow receipt of a fastener head to avoid interference with said snare drum shell;

one or more shell-to-adapter mounting holes formed in said adapter plate in alignment with said original drum strainer mounting holes according to said first spacing; and an isolation pad configured to mount between said adapter plate and said shell to minimize surface marring;

one or more fasteners received in said strainer-to-adapter mounting holes affixing an aftermarket snare drum strainer to said adapter plate;

one or more fasteners received in said shell-to-adapter mounting holes affixing a snare drum shell to said adapter plate; and at least one fastener received through said common hole affixing said aftermarket snare drum strainer to said adapter plate and further to said shell.

2. A method of retrofitting an aftermarket Snare Drum Strainer to a snare drum in place of an original Snare Drum Strand Tensioner comprising:

(a) removing an original Snare Drum Strand Tensioner from a snare drum shell to expose a plurality of original mounting holes formed in said shell, said original mounting holes having a first spacing;

(b) providing an aftermarket strand tensioner having a plurality of mounting holes in a second spacing, where holes in said first spacing holes in said second spacing do not mechanically align;

(c) providing an adapter plate having:

at least one common hole formed in said adapter plate in alignment with both said first spacing and said second spacing;

one or more tensioner-to-adapter mounting holes formed in said adapter plate in alignment with said aftermarket snare drum tensioner according to said second spacing, at least one of said tensioner mounting holes being countersunk to allow receipt of a fastener head to avoid interference with said snare drum shell;

one or more shell-to-adapter mounting holes formed in said adapter plate in alignment with said original drum strand tensioner mounting holes according to said first spacing; and an isolation pad configured to mount between said adapter plate and said shell;

(d) affixing said aftermarket snare drum tensioner to said adapter plate using one or more fasteners received in said strainer-to-adapter mounting holes;

(e) affixing said snare drum shell to said adapter plate using one or more fasteners received in said shell-to-adapter mounting holes; and (f) affixing said aftermarket snare drum strainer to said adapter plate and further to said shell using at least one fastener received through said common hole.

3. The adapter as set forth in claim 1 wherein said isolation pad comprises a neoprene rubber pad.

4. A device for allowing a person to easily and securely fasten an aftermarket snare drum strainer to a snare drum shell without damaging the snare drum shell or the aftermarket snare drum strainer comprising:

said snare drum having a plurality of original drum strainer mounting holes formed in said shell according to a first spacing, said aftermarket snare drum strainer having a plurality of mounting holes according to a second spacing, where holes in said first spacing holes in said second spacing do not mechanically align, said adapter comprising:

an adapter plate having:

one or more shell-to-adapter mounting holes formed in said adapter plate in alignment with original drum strainer mounting holes in said snare drum shell according to a first spacing, said original mounting holes having been formed in said shell to accommodate an original snare drum strainer;

one or more strainer-to-adapter mounting holes formed in said adapter plate in alignment with mounting holes of a selected aftermarket snare drum strainer according to a second spacing, where said first spacing and said second spacing do not mechanically align, at least one of said strainer mounting holes being countersunk to allow receipt of a fastener head to avoid interference with said snare drum shell; and at least one common hole formed in said adapter plate in alignment with a hole in both said first spacing and said second spacing by positioning of said adapter plate with said drum shell original mounting holes and said aftermarket strainer mounting holes by a person;

an isolation pad configured to be mounted between said adapter plate and said drum shell;

a plurality of fasteners configured to be received in said strainer-to-adapter mounting holes to affix said aftermarket snare drum strainer to said adapter plate by said person;

a plurality of fasteners configured to be received in said shell-to-adapter mounting holes to affix a snare drum shell to said adapter plate by said person; and at least one fastener received through said common hole affixing said aftermarket snare drum strainer to said adapter plate and further to said drum shell by said person.

* * * * *